US005764124A

United States Patent [19]

Nakamichi et al.

[11] Patent Number: 5,764,124

[45] Date of Patent: Jun. 9, 1998

[54] IGNITION COIL FOR AN INTERNAL COMBUSTION ENGINE

[75] Inventors: Kazutaka Nakamichi; Kouji Yoshikawa, both of Obu; Katsuji Ishikawa, Hekinan; Toshiro Suzuki, Nissin, all of Japan

[73] Assignee: Aisan Kogyo Kabushiki Kaisha, Obu, Japan

[21] Appl. No.: 657,544

[22] Filed: Jun. 4, 1996

[30] Foreign Application Priority Data

Jun. 9, 1995 [JP] Japan ..... 7-168062
Jun. 9, 1995 [JP] Japan ..... 7-168253

[51] Int. Cl.[6] ..... H01F 27/02; H01F 27/30

[52] U.S. Cl. ..... 336/92; 336/96; 336/107; 336/110; 336/198

[58] Field of Search ..... 336/107, 96, 198, 336/208, 92; 123/634, 635, 169 PA

[56] References Cited

U.S. PATENT DOCUMENTS 4,763,094 8/1988 Kojima .
5,349,320 9/1994 Suzuki et al. ..... 336/92

FOREIGN PATENT DOCUMENTS

A-6-77066 3/1994 Japan .

*Primary Examiner*—Thomas J. Kozma
*Attorney, Agent, or Firm*—Oliff & Berridge, PLC

[57] ABSTRACT

The invention is directed to an ignition coil for an internal combustion engine which includes a housing having therein a first core, a second core which is received in the housing and magnetically connected to the first core for forming a magnetic path therewith, a bobbin having a cylindrical portion for receiving therein the second core with an end face thereof exposed to the outside of the cylindrical portion, a primary winding wound around the bobbin, a secondary winding wound around the primary winding in co-axial relationship therewith, and a permanent magnet which is disposed between the first core and the second core. The permanent magnet has a planar surface connected to the end face of the second core, and an extending end portion which extends out of the end face of the second core. The housing and the bobbin are arranged to enclose the extending end portion of the permanent magnet. Then, a synthetic resin is filled in the housing for fixing and insulating the first core, the second core, the primary winding, the secondary winding, and the permanent magnet. It may be so arranged that the housing has a stepped portion therein, and a recess is formed on the stepped portion for receiving the extending end portion of the permanent magnet, so as to shield the extending end portion. In addition, this extending end portion may be shielded by a wall portion formed on the bobbin.

22 Claims, 9 Drawing Sheets

IGNITION COIL FOR AN INTERNAL COMBUSTION ENGINE

BACKGROUND OF THE INVENTION

1. Field of the Invention

The present invention relates to an ignition coil for use in an internal combustion engine, more particularly to an ignition coil having a primary winding and a secondary winding received in a housing with a synthetic resin filled therein.

2. Description of the Related Arts

A conventional ignition coil for an internal combustion engine is provided with a primary winding and a secondary winding which are disposed around a core, respectively. The primary winding is electrically connected to a control circuit for controlling a primary current, and the secondary winding is electrically connected to an ignition plug through a high-tension terminal. In Japanese Patent Laid-open Publication No. 6-77066, for example, there is disclosed an ignition coil which includes a first core received in a case, a second core arranged in a certain place relative to the first core to form a magnetic path together with the first core, a primary winding and a secondary winding wound around the second core. The ignition coil further includes a primary bobbin which accommodates the second core, and around which at least the primary coil is wound, a connecting portion which is connected to the primary bobbin and provided with a primary terminal for connecting with a wire of the primary winding, a connector portion which is connected to the connecting portion and provided with a connector terminal for connecting with at least the primary terminal, thereby to form a primary coil assembly. This primary coil assembly is disposed in the case so that at least a portion of the first core is placed in a space which is defined by the primary bobbin, the connecting portion and the connector portion. According to the ignition coil disclosed in the publication, number of parts can be reduced, and connection between the first core received in the case and the second core accommodated in the primary bobbin can be made easily and appropriately. Thus, the coil can be assembled into an ignition coil adequately.

Also disclosed in the publication is a structure which forms a holding portion between the connecting portion of the primary coil assembly and the primary bobbin, with an end face of the second core exposed to the holding portion. On the holding portion, a holding member is provided around the periphery of the end face of the second core, and a permanent magnet is arranged so as to contact the end face of the second core and held by the holding member. With that structure, the permanent magnet can be arranged certainly in a certain position of the end face of the second core, so that a desired increase of the output power can be achieved with the permanent magnet disposed between the first core and the second core.

According to the ignition coil disclosed in the above-identified publication, a resin such as an epoxy resin is filled into a case. In this case, if there are members made of different material from the resin, such as a metallic core and a permanent magnet, the resin may be cracked due to the difference in thermal expansion coefficient between the members and the resin. The permanent magnet 5 as shown in FIG. 3 of the publication has an end face of substantially the same surface with an outer surface of a primary bobbin 11. That is, the end face of the permanent magnet, which is exposed to the inside of the case, and the outer surface of the primary bobbin, which is connected to the end face of the permanent magnet, are the same, so that an edge portion of the permanent magnet does not expose to the inside of the case. Then, any serious problem will be caused, as far as the crack is concerned. However, in the case where the edge portion of the permanent magnet is exposed to the inside of the case due to an error in manufacturing or assembling, or in the case where a large permanent magnet is provided so that its edge portion necessarily extends out of the primary bobbin, the resin portion may be cracked. In order to ensure a necessary insulating property within the case, any cracks are to be avoided.

Also, according to the ignition coil disclosed in the above-identified publication, terminals 6*a*, 6*b* which serve as primary terminals are mounted vertically on a connecting portion 14, to which wires of the opposite ends of a primary winding are connected and soldered. With this structure, however, it takes much time to connect them. Therefore, a further improvement has been required to connect them properly. As an alternative measure, if a lead member is folded to hold the wire, and then welded by a spot welding under pressure, or welded by a fusion welding, it would be easy to connect them. According to such structure as disclosed in the publication, however, it is impossible to place a working tool at necessary positions. In order to solve this specific problem, if a working hole is provided on the connecting portion of the bobbin, and the lead member is arranged in parallel with a surface including the working hole, then the welding can be made. However, when the inside of the case is molded by the resin, e.g., epoxy resin, it is filled into the working hole to be hardened therein. Since the resin is different from the material of the connecting portion, e.g., polybutylene terephtalate, the resin may be cracked due to the difference in thermal expansion coefficient between them.

SUMMARY OF THE INVENTION

Accordingly, it is an object of the present invention to provide an ignition coil for an internal combustion engine, wherein a permanent magnet is received in a housing together with a primary winding and a secondary winding, and a resin is filled into the housing without causing the resin to be cracked in the vicinity of the permanent magnet, thereby to keep its insulating property.

It is another object of the present invention to provide an ignition coil for an internal combustion engine, wherein a primary winding is connected to a primary terminal easily and effectively in a housing, and a resin is filled into the housing without causing the resin to be cracked in the vicinity of the primary terminal, thereby to keep its insulating property.

In accomplishing these and other objects, an ignition coil for an internal combustion engine includes a housing having therein a first core, a second core which is received in the housing and magnetically connected to the first core for forming a magnetic path therewith, a bobbin having a cylindrical portion for receiving therein the second core with an end face thereof exposed to the outside of the cylindrical portion, a primary winding wound around the bobbin, a secondary winding wound around the primary winding in co-axial relationship therewith, and a permanent magnet which is disposed between the first core and the second core. The permanent magnet has a planar surface which is connected the end face of the second core, and an extending end portion which extends out of the end face of the second core. The housing and the bobbin encloses the extending end portion of the permanent magnet. A synthetic resin is filled in the housing for fixing and insulating the first core, the second core, the primary winding, the secondary winding, and the permanent magnet.

Preferably, it may be so arranged that the housing has a stepped portion therein, and a recess is formed on the stepped portion for receiving the extending end portion of the permanent magnet. It is preferable that the bobbin has a wall portion for shielding the extending end portion of the permanent magnet received in the recess.

The ignition coil may further comprise a primary terminal for connecting with a wire of the primary winding, and the bobbin may include a support portion for supporting the bobbin in the housing, and a connecting portion for connecting the support portion with the cylindrical portion. It is preferable that the connecting portion has a working hole which is provided at a position facing with the primary terminal, and that the housing has a plugging member which fits into the working hole when the bobbin is received in the housing. The plugging member may be formed as a protruding portion extending from the inside of the housing, so that the protruding portion may fit into the working hole when the bobbin is received in the housing.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 1:
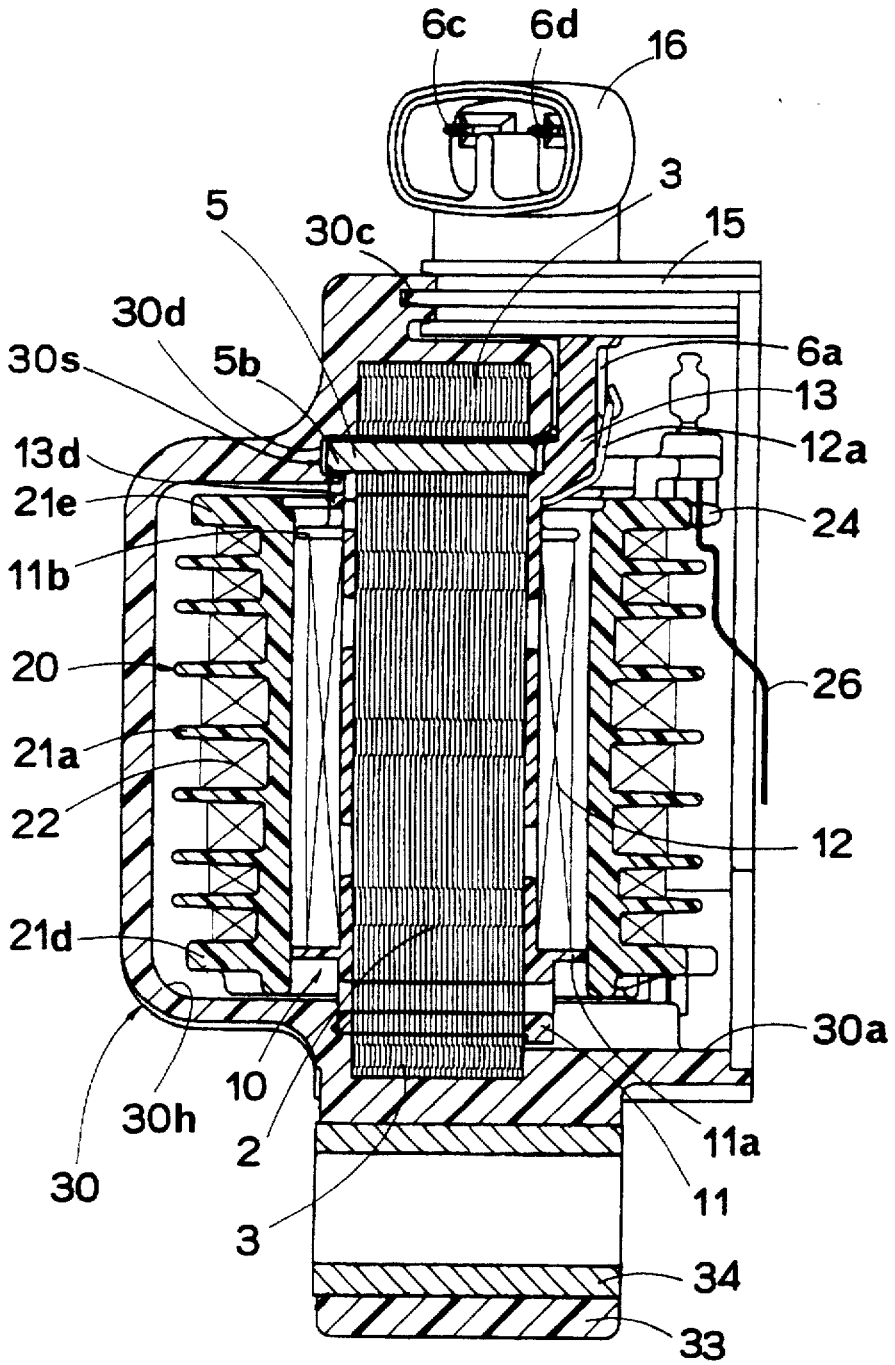
FIG. 1 is a vertically sectioned view of an ignition coil for an internal combustion engine according to an embodiment of the present invention.
Figure 2:
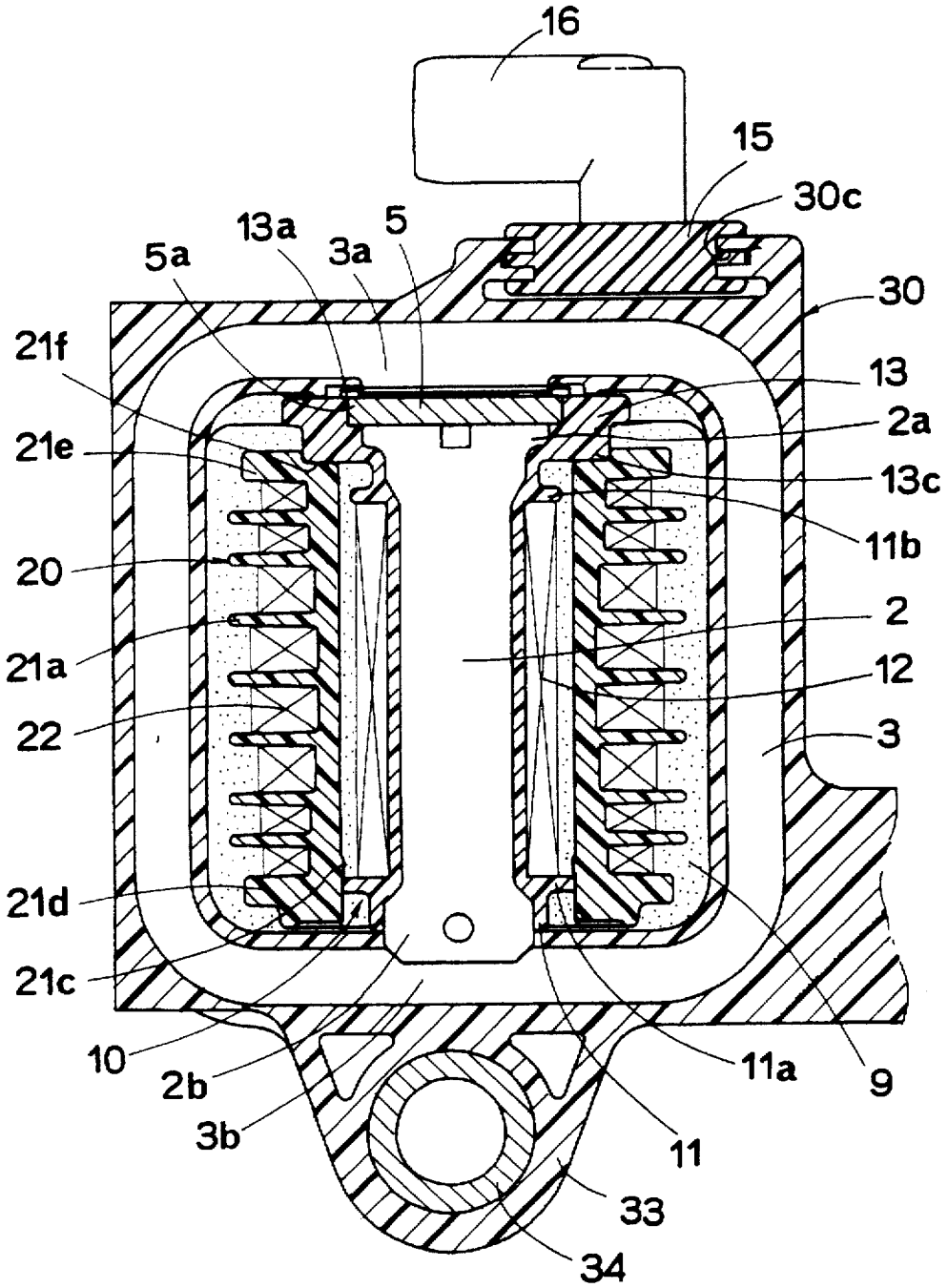
FIG. 2 is a horizontally sectioned view of the ignition coil according to the embodiment of the present invention.
Figure 3:
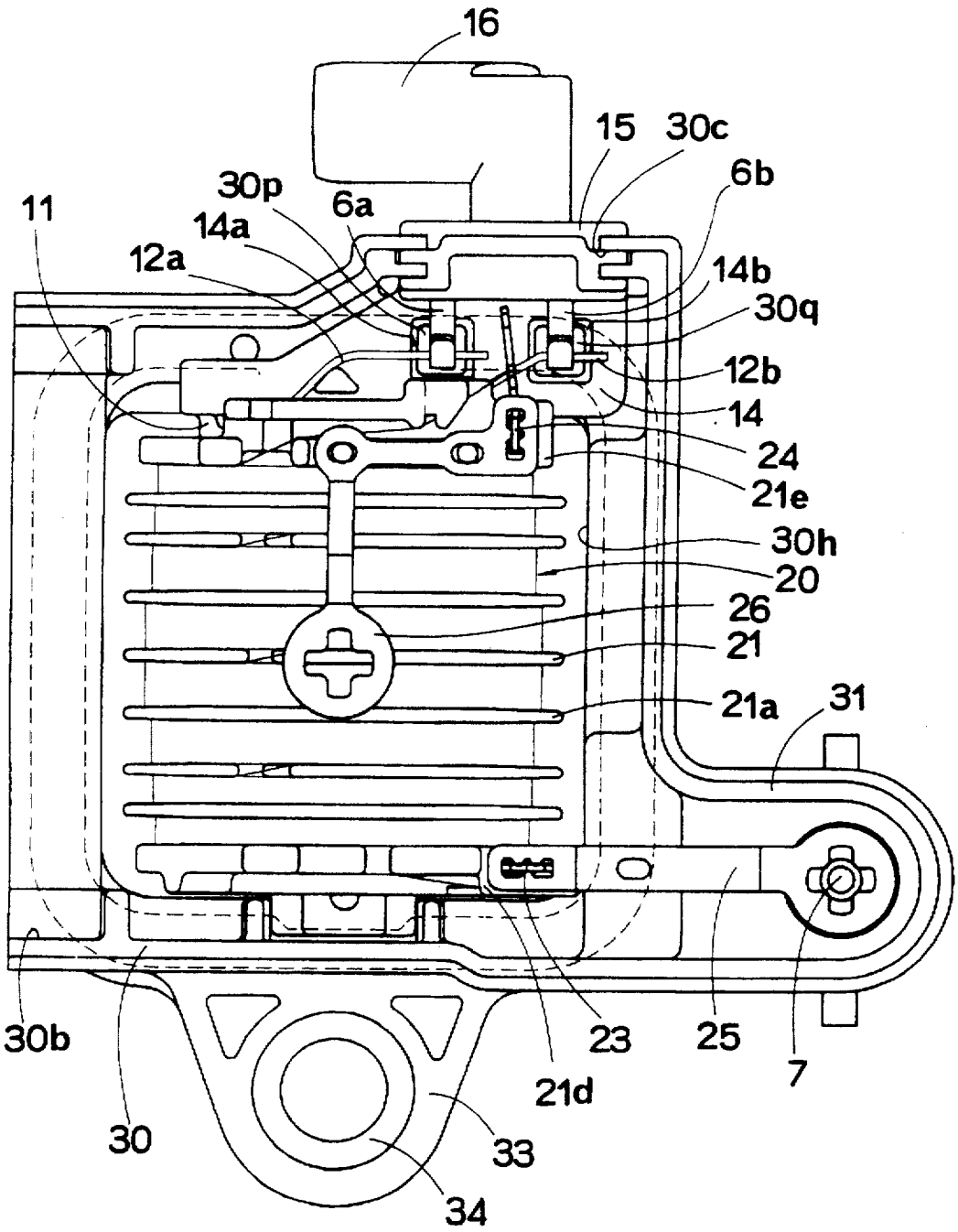
FIG. 3 is a plan view of the ignition coil according to the embodiment of the present invention.
Figure 4:
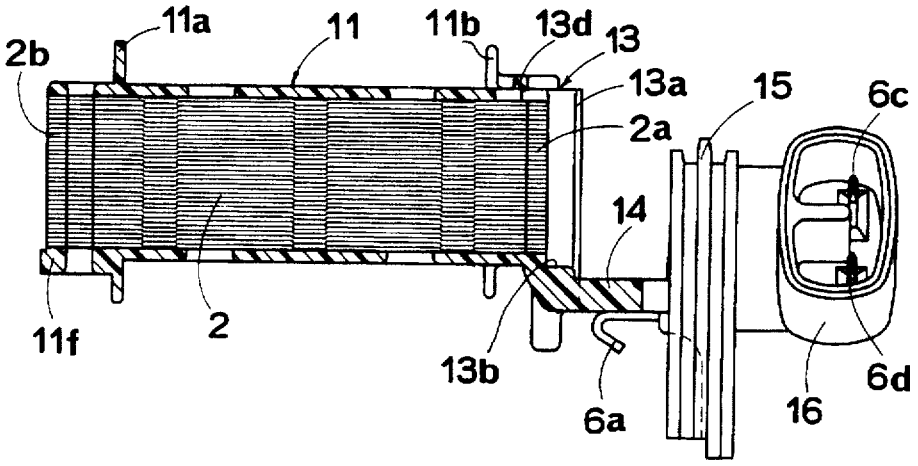
FIG. 4 is a partially sectioned front view of a primary coil assembly without a primary winding according to the embodiment of the present invention.
Figure 16:
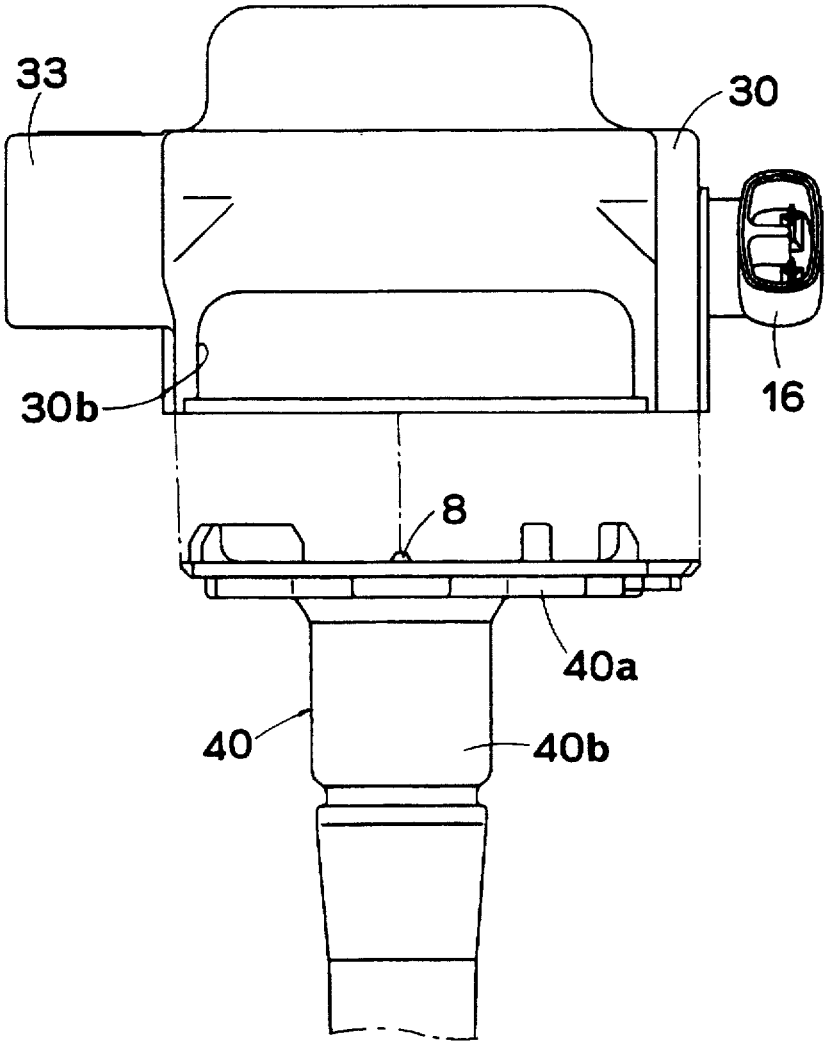
FIG. 16 is a side view of the upper case and a lower case connected therewith according to the embodiment of the present invention.

Referring to FIG. 16, there is illustrated an ignition coil according to an embodiment of the present invention. A housing of the present embodiment includes an upper case 30 and a lower case 40 which are combined together. As shown in FIGS. 1–3, a secondary coil assembly 20 is assembled into a primary coil assembly 10, and these assemblies are received in the upper case 30 to form the structure as shown in FIG. 3. The ignition coil according to the present embodiment is of a simultaneous ignition system (sometimes referred to as a double ignition system), which has an I-letter core 2 and a rectangular frame core 3 to form a magnetic path of approximate B-letter shape as shown in FIG. 2. The core 2 is molded in the primary coil assembly 10, while the core 3 is integrally accommodated in the upper case 30 to be embedded therein except for a portion of the core 3. The structure of the primary coil assembly 10 is shown in FIGS. 7–10, and its structure before the primary winding 12 is wound as shown in FIGS. 4–6.

Figure 11:
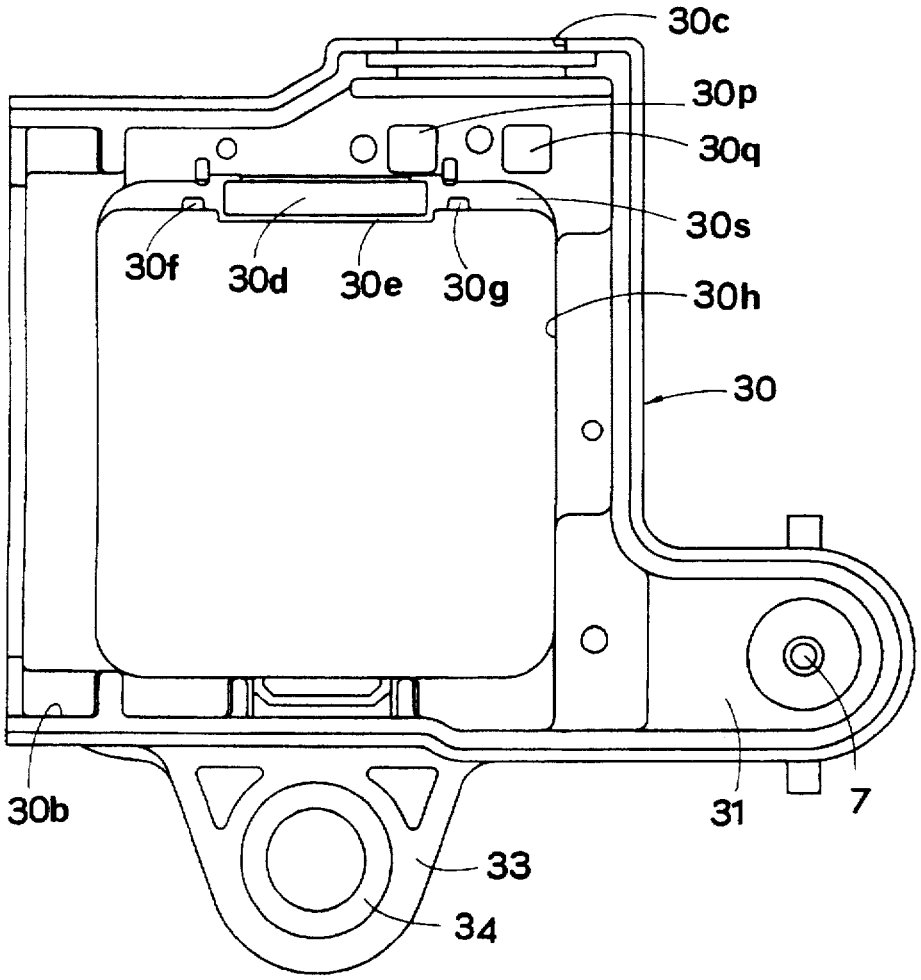
FIG. 11 is a plan view of an upper case according to the embodiment of the present invention.

The upper case 30 is a box-like case made of synthetic resin such as polybutylene terephthalate (PBT) to form a planar configuration as shown in FIG. 11, and the core 3 is molded integrally with the case 30 by insert molding. The primary coil assembly 10 and the secondary coil assembly 20 are received in the inside **30*h* of the upper case 30. The upper case 30 has an opening portion 30*a* formed at its right side in FIG. 1 (the side to be fixed to the lower case 40), and an opening portion 30*b* formed at its left side in FIG. 3. A high-tension terminal portion 31 extends from a side opposite to the opening portion 30*b*, and a high-tension terminal 7 (its head portion appears in FIG. 3) is received in the high-tension terminal portion 31. There is formed on the upper side of the upper case 30 in FIG. 3, an opening portion 30*c* into which a support portion 15 is fitted, and a flange portion 33 extends from the lower side in FIG. 3 opposite to the opening portion 30*c*. A collar 34 is embedded in the flange portion 33** by insert molding.

The core 3 which serves as the first core according to the present invention is constituted by non-oriented silicon steel plates stacked one on the other, or laminated in a form of a rectangular ring member, for example, while it may be constituted by grain oriented silicon steel plates. As shown in FIG. 2, the core 3 has a junction portion **3*a* which is formed broad and extends inwardly to face with the core 2, and a recess 3*b* which is formed on the opposite side to the junction portion 3*a*, and these are exposed to the inside of the upper case 30. On the other hand, the core 2 has a rectangular columnar iron core having a broadened junction 2*a* at its one end, and a broadened junction 2*b* at its the other end. The core 2** is constituted by grain oriented silicon steel plates which are rolled in its axial direction and stacked one on the other, i.e., laminated.

Figure 5:
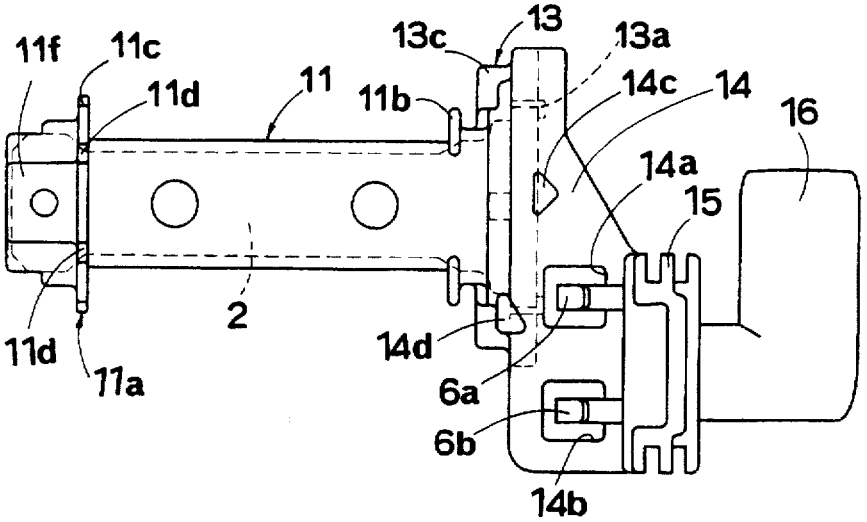
FIG. 5 is a plan view of the primary coil assembly without the primary winding according to the embodiment of the present invention.
Figure 6:
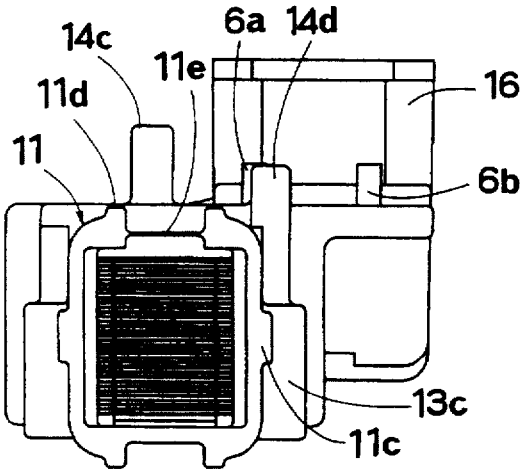
FIG. 6 is a side view of the primary coil assembly without the primary winding according to the embodiment of the present invention.
Figure 7:
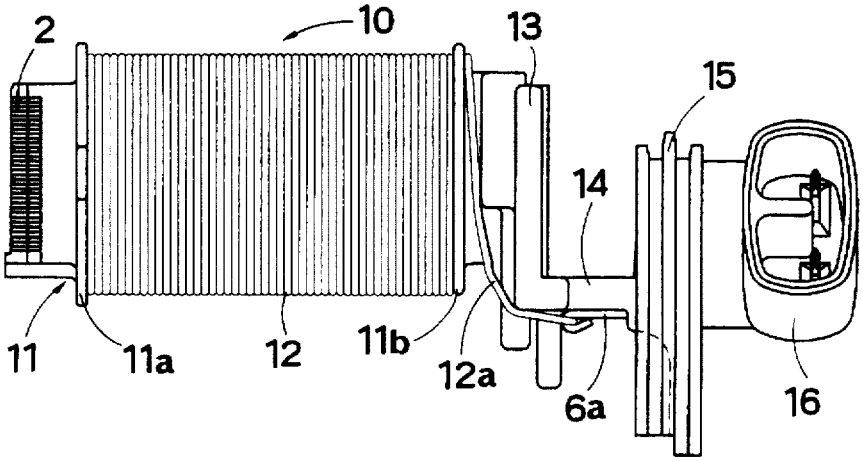
FIG. 7 is a front view of the primary coil assembly according to the embodiment of the present invention.

The primary coil assembly 10 includes a primary bobbin 11, a holding portion 13, a connecting portion 14, a support portion 15 and a connector portion 16, which are made of synthetic resin as shown in FIGS. 4–10, and accommodates the core 2, a pair of primary terminals **6*a*, 6*b* and a pair of connector terminals 6*c*, 6*d* which are molded integrally by insert-molding. The primary bobbin 11** is formed around the core 2, and provided with collars 11*a*, 11*b*, near opposite ends of the core 2, respectively. The collar 11*a* has a protrusion 11*c* on each of a pair of opposite sides, and a pair of protrusions 11*d* on each of the other pair of opposite sides, as shown in FIGS. 5 and 6. The protrusions lid are arranged to be fitted into a hollow portion of a secondary bobbin 21 which will be described later. The protrusion 11*c*is arranged to be engageable with a stepped portion 21*c* (in FIG. 2) formed on an inner surface of the secondary bobbin 21, thereby to limit an axial movement of the primary coil assembly 10. Between the protrusions lid, there is formed a channel 11*e* (in FIG. 6) through which a molding resin which will be described later, will be filled into the hollow portion of the secondary bobbin 21. The primary bobbin 11 has an extending portion 11*f* which extends from the collar 11*a* to cover the junction 2*b*.

Figure 10:
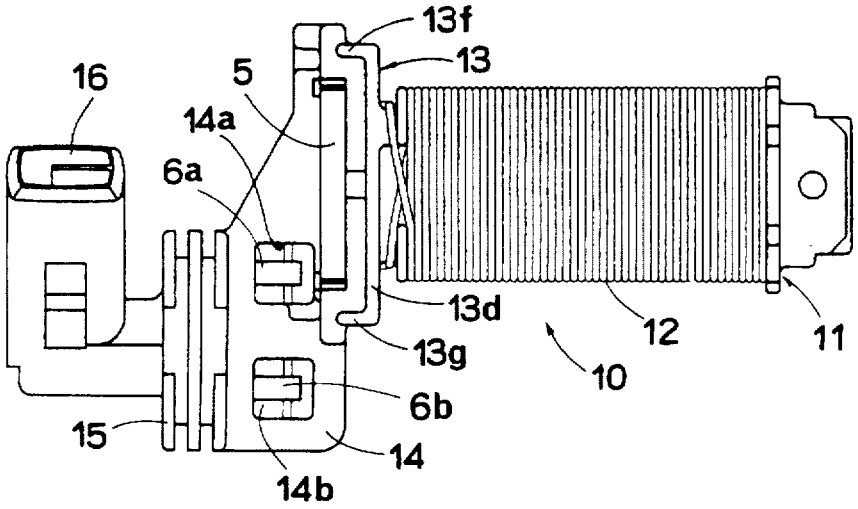
FIG. 10 is a rear view of the primary coil assembly according to the embodiment of the present invention.

The holding portion 13 extends from the primary bobbin 11 to hold a permanent magnet 5 in contact with the junction 2*a* of the core 2. The holding portion 13 is formed to expose a longitudinal end face of the junction 2*a* as shown in FIG. 2, and form a recess 13*b* as shown in FIG. 4, and provide a pair of holding members 13*a* at longitudinally opposite ends of the the recess 13*b* as shown in FIGS. 2 and 5. Accordingly, when the permanent magnet 5 is inserted into the recess 13*b* from the upper side in FIG. 4, it is held at a predetermined position by the holding members 13*a* thereby to contact with the junction 2*a* of the core 2. The permanent magnet 5 is arranged to provide a magnetic flux in a direction opposite to the direction of the magnetic flux which is produced in the cores 2, 3, when the primary winding 12 is fed with the electric current. As shown in FIG. 5, the holding member 13 is formed with a protrusion 13*c* which extends toward the collar 11*b*. Furthermore, as shown in FIG. 10, the holding member 13 has wall portions 13*d*, 13*f*, 13*g* elevated therefrom, which provide a wall portion of a C-letter shape to shield the permanent magnet 5 from a space in which the primary bobbin 11 is accommodated. Thus, the holding portion 13 is arranged so that its longitudinal axis is perpendicular to an axis of the primary bobbin 11, and the support member 15 is arranged to extend perpendicularly to a planar surface of the connecting portion 14, i.e., in parallel with a planar surface of the permanent magnet 5 which is held by the holding member 13. Therefore, the C-letter shape is formed by the holding portion 13, connecting portion 14 and support portion 15, as shown in FIG. 4. The connecting portion 14 may be made separately from the primary bobbin 11 and etc., and connected together thereafter.

Figure 8:
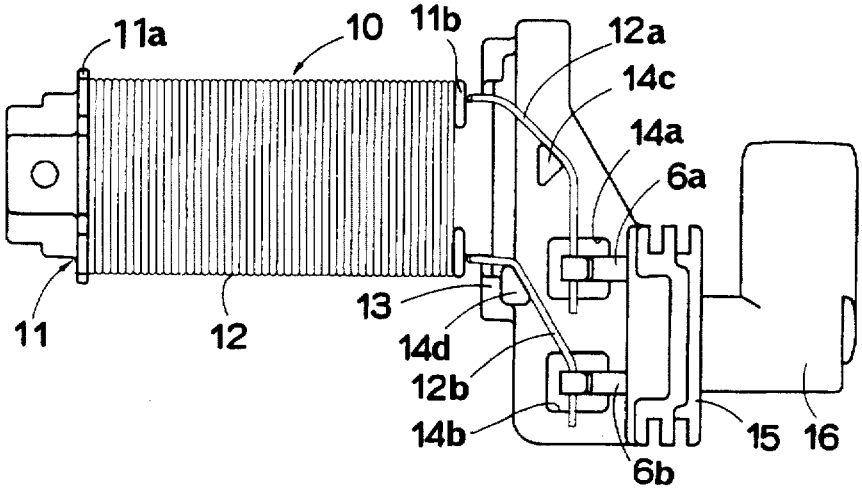
FIG. 8 is a plan view of the primary coil assembly according to the embodiment of the present invention.
Figure 9:
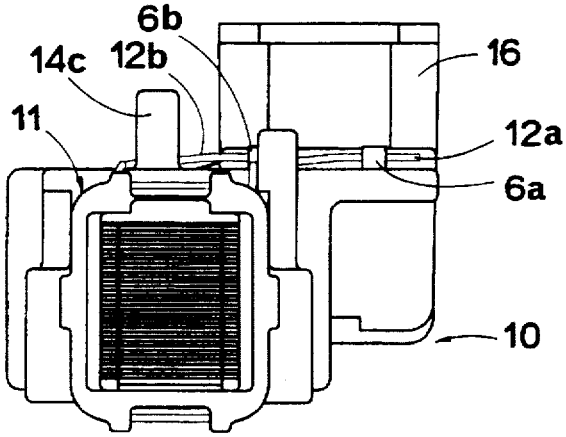
FIG. 9 is a side view of the primary coil assembly according to the embodiment of the present invention.

As shown in FIG. 5 and 8, there are provided on the connecting portion 14 approximately square working holes 14*a*, 14*b*, in the vicinity of which guide portions 14*c*, 14*d* of triangular columns which guide a wire of the primary winding 12 in a certain direction. Furthermore, the support portion 15 is connected integral with the connecting portion 16. The base portions of the primary terminals 6*a*, 6*b* are embedded on the support portion 15 to be supported on the planar surface of the connecting portion 14. The connector terminals 6*c*, 6*d* are embedded in the connector portion 16. Conductors (not shown) for connecting the primary terminal 6*a* with the terminal 6*c*, and conductors (not shown) for connecting the primary terminal 6*b* with the terminal 6*d* are accommodated in the support portion 15 and connecting portion 16. The primary terminals 6*a*, 6*b* are made of metallic lead member, and folded in a J-letter shape as shown in FIG. 4, in such a manner that planar portions of their tip ends are placed opposite to the working holes 14*a*, 14*b*.

As shown in FIGS. 7–10, the primary winding 12 is wound around the primary bobbin 11 to provide the primary coil assembly 10. That is, the primary winding 12 is disposed with its wire wound around the primary bobbin 11 between the collars 11*a* and 11*b* thereby to provide two or four layers. Wires 12*a*, 12*b* of the opposite ends of the primary terminal 12 are guided by the guide portions 14*c*, 14*d* to be held by the tip ends of the primary terminals 6*a*, 6*b*, respectively, and welded by a fusion welding under pressure. In general, the fusion welding method is a method which applies a welding material to the portions to be connected together without any pressure applied thereto. In the present embodiment, however, an end of a winding is held in the folded portions of the primary terminals 6*a*, 6*b*, the portions to be connected are pressed between upper and lower electrodes, and melted by the Joule heating to connect the portions. Therefore, in a strict wording of the term, the welding method may not be of the fusion welding, but may be of a kind of a spot welding. In any case, it is necessary to apply the electrodes onto the opposite sides of the primary terminals 6*a*, 6*b*. According to the present embodiment, the primary terminals 6*a*, 6*b* and the windings 12*a*, 12*b* are welded through the working holes 14*a*, 14*b*, respectively, before these parts are assembled into the upper case 30 which will be described later. The connector 16 is electrically connected to a connector (not shown) outside of the upper case 30. The terminal 6*c* is connected to a battery (not shown), while the terminal 6*d* is connected to a control circuit, i.e., a so-called igniter (not shown).

The permanent magnet 5 which is held by the holding portion 13 is formed in a rectangular plate. The length of one side of the plate is slightly greater than that of one side of the end face of the junction 2*a* of the core 2 as shown in FIG. 2, and the length of the other side of the plate is slightly greater than that of the other side of the end face of the junction 2*a* as shown in FIG. 1. That is, the area of the planar surface of the permanent magnet 5 is greater than the area of the end face of the junction 2*a*, so that an end portion 5*b* extends out of the junction 2*a* of the core 2 to serve as an extending end portion according to the present invention. The permanent magnet 5 may be made from a sintered rare earth metal magnet of samarium-cobalt (Sm-Co) which has a large residual magnetic flux density and such a property as to be hardly demagnetized. According to the present embodiment, the permanent magnet 5 is fitted into the holding portion 13 after the primary winding 12 has been wound around the primary bobbin 11. However, the permanent magnet 5 may be fitted into the holding portion 13 before the primary winding 12 is wound around the primary bobbin 11.

The secondary coil assembly 20 includes the secondary bobbin 21 and a secondary winding 22 disposed thereon. The secondary bobbin 21 is made of synthetic resin and formed into a cylinder with an approximately rectangular cross section. A plurality of collars (represented by 21*a*) are formed on the secondary bobbin 21 with a certain space between adjacent two of the collars 21*a* along the axis of the secondary bobbin 21. The wire of the secondary winding 22 is wound in each space between the collars 21*a*. Since a simultaneous ignition system is employed in the present embodiment, collars 21*d*, 21*e* formed at opposite ends of the collars 21*a* of the secondary bobbin 21 have a relatively broad width respectively, and the secondary terminals 23, 24 are embedded on the collars 21*d*, 21*e* at the opposite ends of the collars 21*a*, as shown in FIG. 3. The secondary bobbin 21 has one end face on which a recess 21*f* (in FIG. 2) is formed to receive therein a protrusion 13*c* (in FIGS. 5 and 6) of the primary bobbin 11. Therefore, when the primary bobbin 11 of the primary coil assembly 10 is inserted into the hollow portion of the secondary bobbin 21, the protrusion 11*c* of the collar 11*a* rides over the stepped portion 21*c* of the secondary bobbin 21 to be engaged therewith, and the protrusion 13*c* is fitted into the recess 21*f*. Whereby, the primary bobbin 11 is supported at the opposite ends thereof in the secondary bobbin 21, so that relative movements between the primary bobbin 11 and the secondary bobbin 21 in both of the longitudinal direction and lateral direction are limited to provide a stable connection therebetween.

Figure 12:
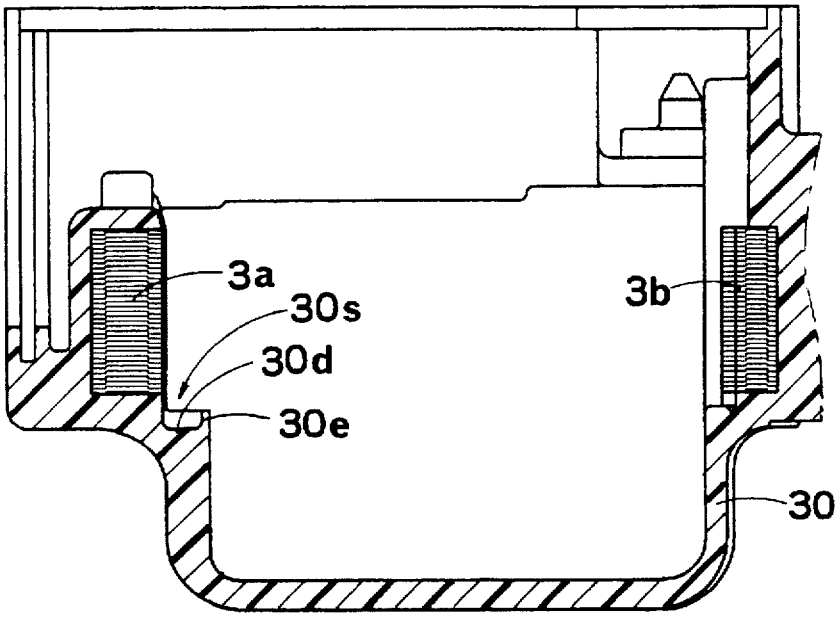
FIG. 12 is a vertically sectioned view of the upper case according to the embodiment of the present invention.

As shown in FIG. 3, the opposite ends of the wire of the secondary coil 22 are wound around the secondary terminals 23, 24 which are embedded on the collars 21*d*, 21*e*, and to which connection terminals 25, 26 are connected, respectively. One end of the connection terminal 25 is connected to the secondary terminal 23, and the other end is connected to the high-tension terminal 7. Another connection terminal 26 is connected to the secondary terminal 24 to extend in parallel with the axis of the secondary bobbin 21 as shown in FIG. 1. When the lower case 40 is assembled with the upper case 30 as described later, the connection terminal 26 is connected to a high-tension terminal 8 (in FIG. 16) which is mounted on the lower case 40. As shown in FIG. 11, a pair of rectangular protruding portions 30*p*, 30*q* are formed integral with the inside of the upper case 30. The protruding portions 30*p*, 30*q* are formed smaller in configuration than the working holes 14*a*, 14*b* of the connecting portion 14 to be fitted thereinto, and approximately the same in height as a thickness of the connecting portion 14. Within the upper case 30, there is formed as shown in FIGS. 11 and 12 a stepped portion 30*s*, on which a rectangular recess 30*d* is formed to receive therein the end portion 5*b* of the permanent magnet 5, and from which a wall portion 30*e* is elevated at the inside 30*h* of the upper case 30. Furthermore, as shown in FIG. 11, a pair of cutouts 30*f*, 30*g* are formed at opposite sides of the recess 30*d* to face with the wall portions 13*f*, 13*g* of the holding portion 13.

Figure 13:
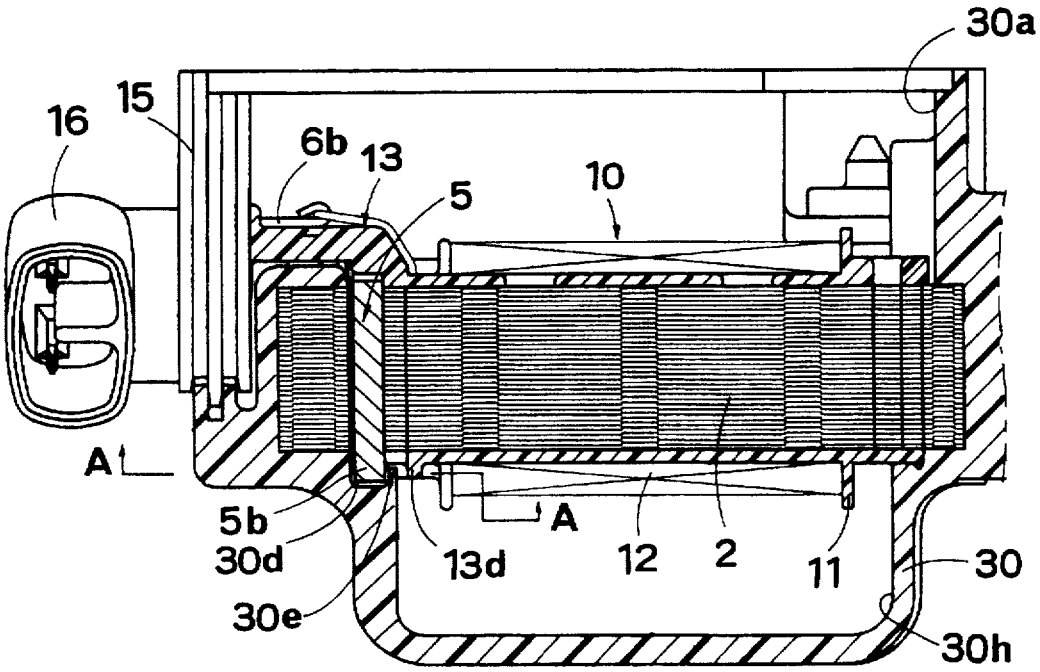
FIG. 13 is a vertically sectioned view of the upper case and the primary coil assembly accommodated therein according to the embodiment of the present invention.
Figure 14:
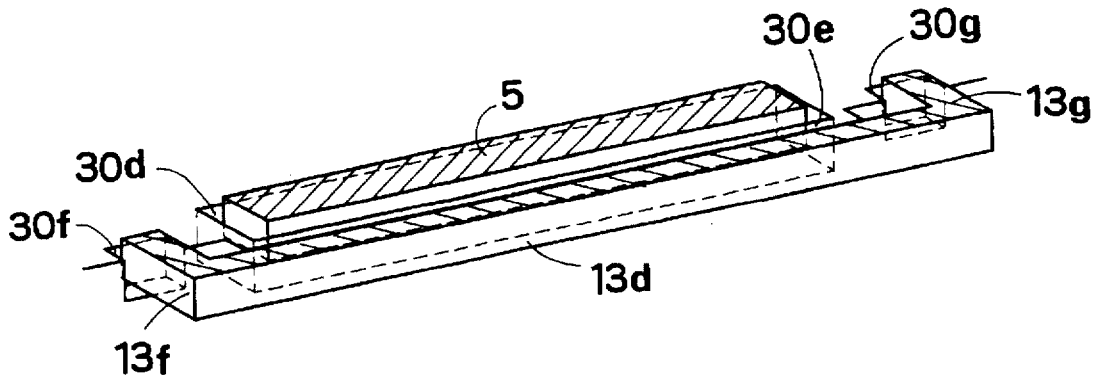
FIG. 14 is a perspective view of a part of the ignition coil in the vicinity of an extended end portion of a permanent magnet, sectioned along A—A line in FIG. 13 according to the embodiment of the present invention.
Figure 15:
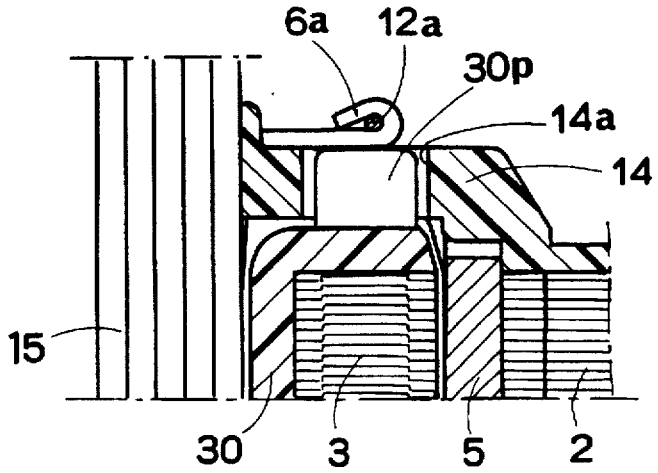
FIG. 15 is an enlarged sectional view of a part of the ignition coil in the vicinity of a working hole of the connecting portion according to the embodiment of the present invention.

In the case where the above-described ignition coil is assembled, the secondary coil assembly 20 is assembled into the primary coil assembly 10, and these assemblies are received in the upper case 30 as shown in FIG. 1, so that the support portion 15 of the primary coil assembly 10 is fitted into the opening portion 30*c* of the upper case 30. Then, the junction 3*a* of the core 3 is fitted into the C-letter shaped portion having the holding portion 13, connecting portion 14 and support portion 15 of the primary coil assembly 10, so that the connecting portion 14 contacts the planar surface of the core 3, and the permanent magnet 5 is placed to face with the laminated end face of the inner side of the junction 3*a* of the core 3, and the junction 2*b* of the core 2 is fitted into the recess 3*b* of the core 3 to contact with each of the laminated layers. As a result, the cores 2, 3 and the permanent magnet 5 are positioned in a predetermined relationship with one another. Thus, the permanent magnet 5 is received in the recess 13*b* of the holding portion 13 to hold the end portion 5*a* by the holding member 13*a*, so that it is placed in a predetermined position between the junctions 2*a*, 3*a* of the cores 2, 3. The end portion 5*b* of the permanent magnet 5 is received in the recess 30*d*, and the wall portions 13*f*, 13*g* of the holding portion 13 are fitted into the cutouts 30*f*, 30*g* of the upper case 30, so that the end portion 5*b* of the permanent magnet 5 is shielded by the wall portion 30*e*, and also shielded by the wall portions 13*d*, 13*f*, 13*g*. In order to illustrate this relationship more clearly, FIG. 13 illustrates the upper case 30 having only the primary coil assembly 10 without the secondary coil assembly 20, and FIG. 14 illustrates an enlarged perspective view of a view sectioned along a line of A—A in FIG. 13. As shown in FIG. 3, the protruding portions 30*p*, 30*q* of the upper case 30 are fitted into the working holes 14*a*, 14*b* of the connecting potion 14, respectively, so that the working holes 14*a*, 14*b* are plugged by the protruding portions 30*p*, 30*q*. In this case, a small clearance may remain between them as shown in FIGS. 3 and 15. After assembled as described above, the tip end of the connection terminal 25 is electrically connected with the high-tension terminal 7.

The upper case 30 is connected to the lower case 40 as shown in FIG. 16. The lower case 40 includes a cover portion 40*a* and a cylindrical body portion 40*b* which extends from the cover portion 40*a* to provide a high-tension connector portion. Both of the cover portion 40*a* and the body portion 40*b* are made of synthetic resin as one body. On the central axis of the body portion 40*b*, accommodated therein by insert-molding is a high-tension terminal 8, one end of which is provided with a boss portion exposed to a side of the lower case 40 connected with the upper case 30. Therefore, when the lower case 40 is assembled with the upper case 30, the connection terminal 26 is electrically connected to the high-tension terminal 8. Thereafter, a thermosetting synthetic resin such as epoxy resin is filled in a space inside of the upper case 30 through the opening portion 30*b*, and set to form a resin portion 9 as indicated by dots in FIG. 2. Thus, the primary and secondary windings 12 and 22 are impregnated and made rigid with such resin, and the insulation is ensured to endure the high-tension output from the secondary winding 22. In this case, the resin is filled into the hollow portion of the secondary bobbin 21, through the channel lie between the protrusions 11*d* of the collar 11*a*, and the clearance between the collars 11*a*, 11*b* and the hollow portion, so that the resin portion 9 is formed without any unnecessary air gaps. The working holes 14*a*, 14*b* of the connecting portion 14 are plugged by the protruding portions 30*p*, 30*q*, with a small clearance between the working holes 14*a*, 14*b* and the protruding portions 30*p*, 30*q*, respectively. The connecting portion 14 and the protruding portions 30*p*, 30*q* are made of the same material, so that the resin will not be cracked due to the thermal expansion of the resin filled in the clearance. Therefore, a stable insulating property is ensured at the portions connecting the wires 12*a*, 12*b* of the primary winding 12 with the primary terminals 6*a*, 6*b*. The relationship between the working hole 14*a* and the protruding portion 30*p*, and that between the primary terminal 6*a* and the wire 12*a* are shown in FIG. 15.

Since it is so constituted that edge portions of the cores 2, 3 do not directly contact with the resin portion 9 by the cover portion 11*f* or the like, the resin portion 9 will not be cracked. Furthermore, since the end portion 5*b* of the permanent magnet 5 is received in the recess 30*d*, and shielded by the wall portions 13*d*, 13*f*, 13*g*, even if the resin portion 9 was cracked at the edge portion of the permanent magnet 5, the wall portions 13*d*, 13*f*, 13*g* could prevent the resin portion 9 from being cracked further within the upper case 30. Even under severe environmental conditions, therefore, the resin portion 9 is prevented from being cracked.

When the above-described ignition coil of the simultaneous ignition system is installed in an internal combustion engine (not shown), the high-tension terminal 8 is directly connected with one ignition plug (not shown), and the high-tension terminal 7 is connected with another ignition plug (not shown) through a high-tension cable (not shown). In operation, when a primary current is fed to the primary winding 12 and cut off, alternately, a counter electromotive force is induced in the secondary winding 22, so that such a high-tension as 30–40 kV is output to each ignition plug through the secondary terminals 23, 24, the connection terminals 25, 27 and the high-tension terminals 7, 8. As a result, a spark discharge is caused at an electrode of the ignition plug to ignite a compressed air-fuel mixture in a combustion chamber (not shown). As described above, the present embodiment relates to the ignition plug of the simultaneous ignition system having dual high-tension terminals 7, 8, while it may be used for a conventional ignition plug for an internal combustion engine, wherein either one of the terminals 7, 8 may be employed.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a housing having therein a first core, said housing having a stepped portion formed therein, and a recess formed on said stepped portion;

a second core received in said housing and magnetically connected to said first core for forming a magnetic path therewith;

a bobbin having a cylindrical portion for receiving therein said second core with an end face thereof exposed to the outside of said cylindrical portion;

a primary winding wound around said bobbin;

a secondary winding wound around said primary winding in co-axial relationship therewith;

a permanent magnet disposed between said first core and said second core, said permanent magnet having a planar surface connected to the end face of said second core, and an extending end portion extending out of the end face of said second core into the inside of said housing, said recess formed on said stepped portion receiving and surrounding said extending end portion of said permanent magnet with said housing recess and said bobbin enclosing said extending end portion; and a synthetic resin filled in said housing for fixing and insulating said first core, said second core, said primary winding, said secondary winding, and said permanent magnet.

2. An ignition coil for an internal combustion engine as set forth in claim 1, wherein said bobbin has a wall portion for shielding said extending end portion of said permanent magnet received in said recess.

3. An ignition coil for an internal combustion engine as set forth in claim 2, wherein said wall portion extends in parallel with said recess, and said wall portion has a longitudinal length longer than a longitudinal length of said recess.

4. An ignition coil for an internal combustion engine as set forth in claim 2, wherein said housing has a pair of cutouts opposing each other in the vicinity of said recess, and wherein said bobbin has a pair of side walls opposing each other to be fitted into said cutouts, respectively.

5. An ignition coil for an internal combustion engine as set forth in claim 4, wherein said wall portion and said side walls of said bobbin provide a C-letter shaped wall for enclosing said extending end portion of said permanent magnet.

6. An ignition coil for an internal combustion engine as set forth in claim 1, further comprising a primary terminal for connecting with a wire of said primary winding, wherein said bobbin includes a support portion for supporting said bobbin in said housing, and a connecting portion for connecting said support portion with said cylindrical portion, wherein said connecting portion has a working hole provided at a position facing with said primary terminal, and wherein said housing has a plugging member which fits into said working hole when said bobbin is received in said housing.

7. An ignition coil for an internal combustion engine as set forth in claim 6, wherein said plugging member is a protruding portion extending from the inside of said housing, and wherein said protruding portion fits into said working hole when said bobbin is received in said housing.

8. An ignition coil for an internal combustion engine as set forth in claim 7, wherein said protruding portion in said housing and said connecting portion of said bobbin are made of the same material.

9. An ignition coil for an internal combustion engine as set forth in claim 8, wherein a thickness of said protruding portion is approximately the same as a thickness of said connecting portion around said working hole.

10. An ignition coil for an internal combustion engine as set forth in claim 6, wherein said primary terminal includes a lead member with a tip end portion thereof folded to secure a wire of said primary winding around said working hole.

11. An ignition coil for an internal combustion engine as set forth in claim 10, wherein said lead member is disposed on a plane including said working hole, with said tip end portion of said lead member placed on said working hole.

12. An ignition coil for an internal combustion engine comprising:

a housing having therein a first core, said housing having a portion with an inwardly extending wall, said housing portion and an inside surface of said inwardly extending wall forming a recess;

a second core received in said housing and magnetically connected to said first core for forming a magnetic path therewith;

a bobbin having a cylindrical portion for receiving therein said second core with an end face thereof exposed to the outside of said cylindrical portion;

a primary winding wound around said bobbin;

a secondary winding wound around said winding in co-axial relationship therewith;

a permanent magnet disposed between said first core and said second core, said permanent magnet having a planar surface facing the end face of said second core and an extending end portion, including a portion of the planar surface, extending laterally beyond said bobbin, said recess receiving said extending end portion of said permanent magnet and the portion of the planar surface of the extending end portion facing said inside surface of said inwardly extending wall so that the housing portion surrounds and substantially encloses the extending end portion of the magnet; and a synthetic resin filled in said housing for fixing and insulating said first core, said second core, said primary winding, said secondary winding, and said permanent magnet.

13. An ignition coil for an internal combustion engine as set forth in claim 12, wherein said bobbin has a wall portion for shielding said extending end portion of said permanent magnet received in said recess.

14. An ignition coil for an internal combustion engine as set forth in claim 13, wherein said wall portion extends in parallel with said recess, and said wall portion has a longitudinal length longer than a longitudinal length of said recess.

15. An ignition coil for an internal combustion engine as set forth in claim 13, wherein said housing has a pair of cutouts opposing each other in the vicinity of said recess, and wherein said bobbin has a pair of side walls opposing each other to be fitted into said cutouts, respectively.

16. An ignition coil for an internal combustion engine as set forth in claim 15, wherein said wall portion and said side walls of said bobbin provide a C-letter shaped wall for enclosing said extending end portion of said permanent magnet.

17. An ignition coil for an internal combustion engine as set forth in claim 12, further comprising a primary terminal for connecting with a wire of said primary winding, wherein said bobbin includes a support portion for supporting said bobbin in said housing, and a connecting portion for connecting said support portion with said cylindrical portion, wherein said connecting portion has a working hole provided at a position facing with said primary terminal, and wherein said housing has a plugging member which fits into said working hole when said bobbin is received in said housing.

18. An ignition coil for an internal combustion engine as set forth in claim 17, wherein said plugging member is a protruding portion extending from the inside of said housing, and wherein said protruding portion fits into said working hole when said bobbin is received in said housing.

19. An ignition coil for an internal combustion engine as set forth in claim 18, wherein said protruding portion in said housing and said connecting portion of said bobbin are made of the same material.

20. An ignition coil for an internal combustion engine as set forth in claim 19, wherein a thickness of said protruding portion is approximately the same as a thickness of said connecting portion around said working hole.

21. An ignition coil for an internal combustion engine as set forth in claim 17, wherein said primary terminal includes a lead member with a tip end portion thereof folded to secure a wire of said primary winding around said working hole.

22. An ignition coil for an internal combustion engine as set forth in claim 21, wherein said lead member is disposed on a plane including said working hole, with said tip end portion of said lead member placed on said working hole.

* * * * *